United States Patent [19]

Humphries et al.

[11] 4,158,447

[45] Jun. 19, 1979

[54] EXPANDING STABILIZING FIN CUP

[75] Inventors: Waymon Humphries; Joseph A. Nahas, both of Laurel, Md.

[73] Assignee: The United States of America as represented by the Secretary of the Navy, Washington, D.C.

[21] Appl. No.: 855,633

[22] Filed: Nov. 29, 1977

[51] Int. Cl.[2] ..... F42B 13/22

[52] U.S. Cl. ..... 244/3.27; 244/3.29

[58] Field of Search ..... 244/3.27, 3.28, 3.29; 102/49.2

[56] References Cited

U.S. PATENT DOCUMENTS

| | | | |
|---|---|---|---|
| 3,031,967 | 5/1962 | Jasse | 244/3.29 |
| 3,072,055 | 1/1963 | Ross | 102/49.2 |
| 3,165,281 | 1/1965 | Gohlke | 244/3.29 |
| 3,580,529 | 5/1971 | Suter | 244/3.29 |
| 3,589,645 | 6/1971 | Haglund | 244/3.27 |

*Primary Examiner*—Verlin R. Pendegrass

*Attorney, Agent, or Firm*—R. S. Sciascia; R. F. Beers; Sol Sheinbein

[57] ABSTRACT

A device for providing fold out fins for stabilizing projectiles or missiles which may be tube-launched. The missile is provided with a tubular element or cup which has a plurality of slots defining fin-like stabilizing flaps. The slots extend circumferentially around two sides of the flaps; a third slot interconnects the circumferential slots, while a fourth side is unslotted. Since the tubular element is in fluid communication with the pressure within the launcher, the stabilizing flaps or fins expand outwardly into position about the fourth unslotted side as the missile or the projectile leaves the launcher.

11 Claims, 3 Drawing Figures

EXPANDING STABILIZING FIN CUP

BACKGROUND OF THE INVENTION

This invention relates to rocket missiles and especially to means for improving the ballistic accuracy of tube-launched rockets.

Military establishments are turning more and more to missiles such as rockets for ground-to-ground, air-to-air, air-to-ground weapons as the solution to their military needs. To stabilize the flight of such rockets, fins are employed, usually at the nozzle end of the rocket.

Rockets which are not spin stabilized, because they are not given spin from the start of the flight, are inaccurate, i.e., they may have large dispersions. Ballistic dispersion is the amount of spread in the striking points of missiles at a given target from the same aiming point and is a measure of the accuracy of a given type of missile. It is obvious that absolute accuracy is the desired object of weapon makers and thus the less dispersion a missile has the more accurate and desirable it is.

The prior art has reduced dispersion appreciably in spinning the rocket during the thrusting phase by utilizing stabilizers which are customarily retactably mounted or folded about the rocket fuselage and adapted to be unfolded by spring action, centrifugal force or both when the missile emerges from its launch tube. Such prior art devices are exemplified by U.S. Pat. Nos. 3,964,696, 3,952,970, issued to Orzechowski et al and U.S. Pat. No. 3,260,205 to Dietrich. These prior art devices suffer in that they are complicated, expensive and difficult to manufacture. Furthermore inasmuch as the prior art devices are complicated their reliability leaves much to be desired.

SUMMARY OF THE INVENTION

It is therefore an object of the present invention to replace complicated and expensive fold-out fins with an expanding stabilizing fin cup.

A further object is to improve the ballistic dispersion and, therefore, accuracy of tube-launched projectiles.

A further object is to improve the reliability of fold-out fins for stabilizing bodies.

These and other objects are accomplished in an expanding stabilizing fin cup whose construction is a hydroformed, spun or drawn aluminum can which is slotted in such a fashion such that upon application of pressure in the cavity of the can, spin fins expand outwardly into a spin stabilizing mode as the missile or projectile leaves the launcher.

Other objects, advantages and novel features of the present invention will become apparent from the following detailed description of the invention when considered in conjunction with the accompanying drawings.

DETAILED DESCRIPTION OF THE INVENTION

Figure 1:
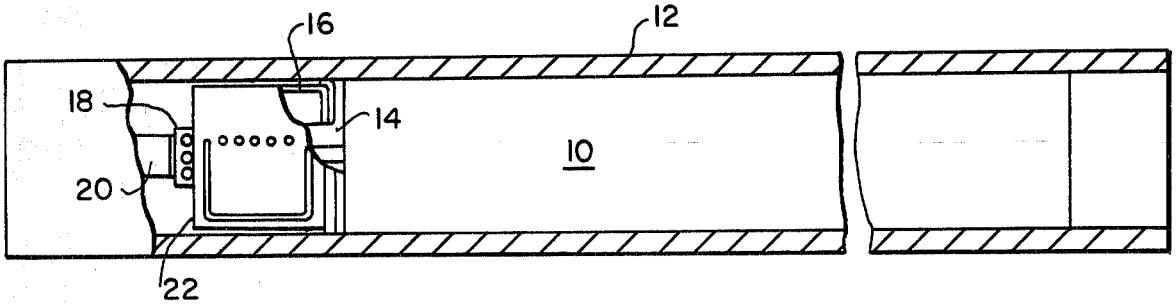
FIG. 1 is a schematic side view of a tube launcher containing a rocket missile embodying the present invention.

Referring now to the drawings wherein like reference characters designate like or corresponding parts throughout the several views, there is shown in FIG. 1 an unguided missile, projectile, rocket 10 adapted to employ the instant invention as hereinafter described. Missile 10 is shown disposed in a tube launcher 12 just prior to launch. The projectile has an aft portion or tail portion 14 which allows the attachment of a stabilizing fin cup 16. Aft portion 14 also provides for a pyrotechnic delay and propelling charge 18 which passes through a cavity formed in the cup 16. An induction coil 20, disposed on the aft portion of the propelling charge and pyrotechnic delay 18, cooperates with an ignition means, not shown, disposed in the tube launcher 12 and controlled by a controller, also not shown.

Figure 2:
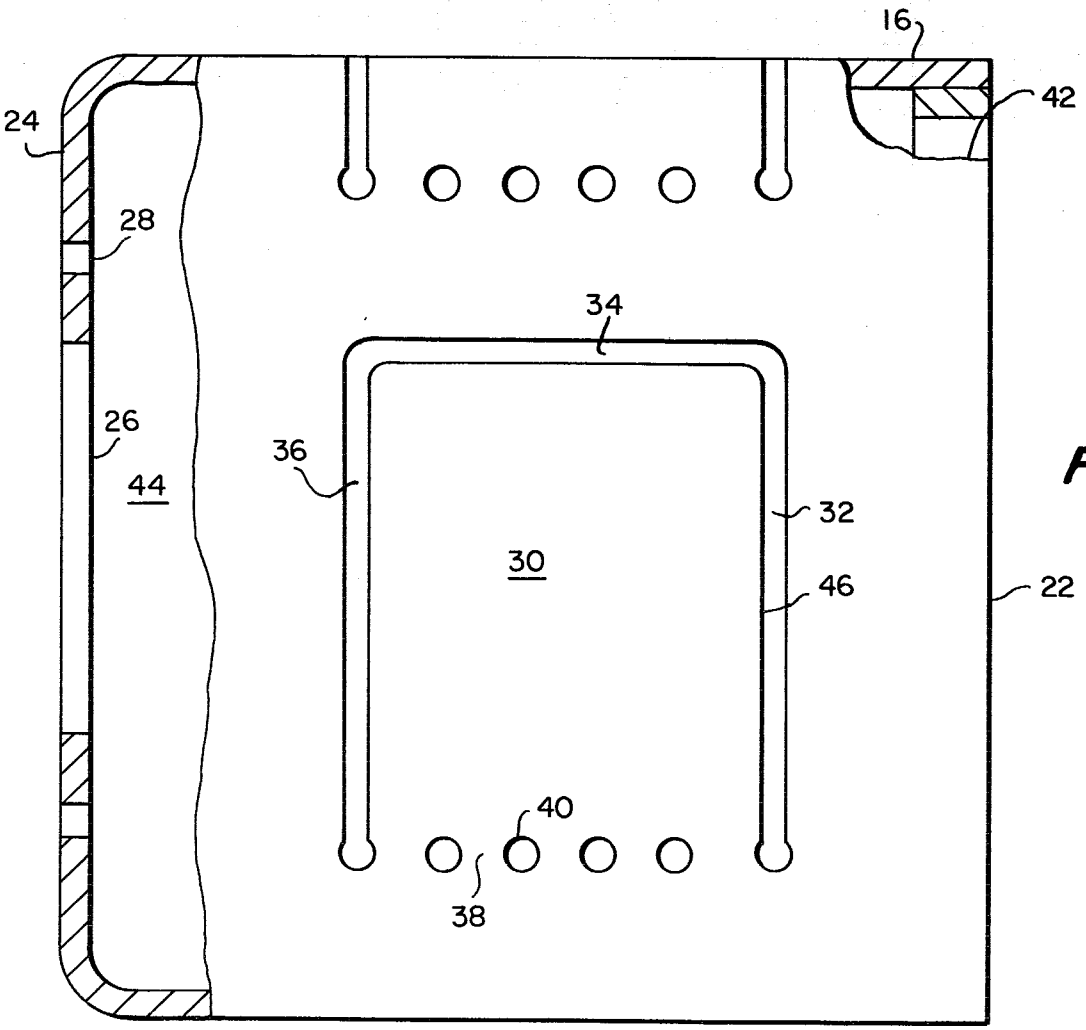
FIG. 2 is a partial view of an expanding stabilizing fin cup of the present invention.

The expanding fin cup of the present invention is more specifically illustrated in FIG. 2 wherein the fin cup 16 is shown as a tubular element, cup or cylindrical body, having an open-ended section 22 and a substantially closed portion 24. Closed portion 24 has an orifice 26, centrally located, which allows for the insertion of the pyrotechnic delay and propelling charge 18 into the cup 16. Mounting means such as holes 28 provide for the attachment of the expanding fin cup to the aft portion 14 of the missile 10.

In this view of the expanding fin cup, spin fins 30 are shown in unexpanded relation to body 16. The number of fins may vary as long as they are symmetrically disposed about the periphery of the cup. Spin fins 30 are formed by cutting a set of circumferential slots 32, 34 and 36. Slots 32 and 36 are formed transverse to the longitudinal axis of the expanding cylindrical body 16. As is apparent from FIG. 2 both slots 32 and 36 are of equal length and slot 34 perpendicularly connects the ends of slots 32 and 36 which lie along the plane which is parallel to the longitudinal axis of the cylindrical body 16. Prior to launch, the configuration of fins 30 is substantially the same as the configuration of body 16, with adjacent fin and body portions, bordering on the slots 32, 34 and 36 defining each fin 30, being substantially flush. A fourth unslotted roat side 38 of each fin 30 may include a plurality of perforations 40 which allows each spin fin 30 to rotate or expand and unfold as the missile clears the tube launcher. While shown in FIG. 2 as having a plurality of perforations along its length, unslotted side 38 may be formed without perforations as in FIG. 3. The perforations 40 do not substantially reduce the structural integrity of the side 38; they merely facilitate the unfolding of the fins during launch.

Disposed proximate end 22 is a reinforcing ring 42 which eliminates mishandling problems, i.e., untoward damage to the fin cup is substantially eliminated. Ring 42 also insures that fins 30 consistently unfold as desired. Finally, fin cup 16 may be constructed of hydroformed, spun, or drawn aluminum.

In use, the missile 10 with the expanding stabilizing fin cups attached thereto, is inserted into a tube launcher 12 with the induction coil 20 inserted into the ignition means of the tube launcher 12. On launch, the propelling charge generates sufficient high pressure to launch the missile 10. This high pressure tends to force each spin fin 30 outwardly so that unfolding and spin stabilization can take place. However, due to the constraint of the walls of the tube launcher 12, the fins are prevented from unfolding so that when the missile clears the tube launcher and the downstream surface 46 of each fin 30 clears the outer portion of the tube launcher 12, the fins should expand as shown in FIG. 3 causing the missile to spin about its roll axis.

Figure 3:
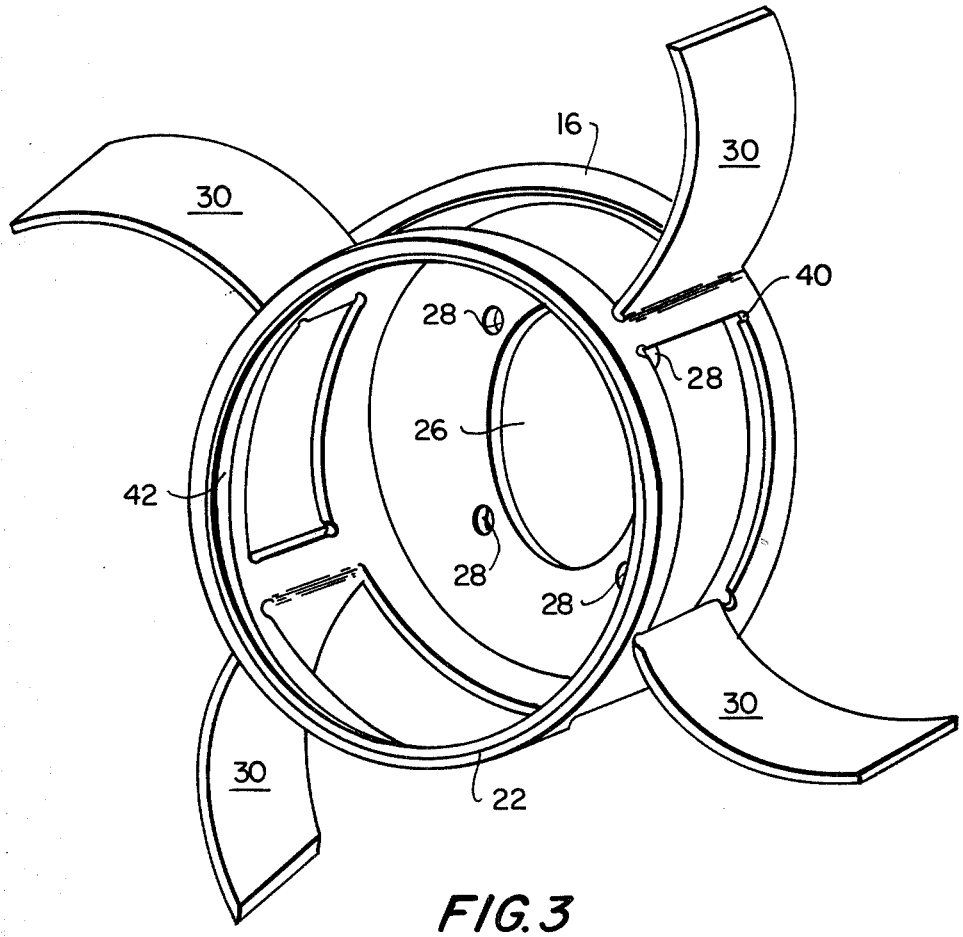
FIG. 3 shows an expanded stabilizing fin cup.

FIG. 3 shows an expanded stabilizing fin cup having four fins to spin stabilize the missile 10. However, as is obvious, any number of fins may be provided. Finally, it should be noted that while the fin cup may have an open portion 22 and a plurality of perforations 40 as well as slots 32, 34 and 36, the pressure within the cavity 44 remains sufficiently high during the course of the missile 10 through the tube launcher 12 so that upon exit of the missile from the tube launcher 12 the fins do in fact unfold.

Thus, what as has been described is a relatively inexpensive, simple and highly reliable stabilizing fin cup device for missiles, rockets and projectiles. Furthermore, this device maintains its structural integrity during rough handling and transportation.

It should be clearly understood that the above-described embodiment is merely illustrative of the invention and may be varied within the scope of the claims which are appended hereto to solve similar problems and to employ equivalent elements as known to those skilled in the art. Modifications of the inventive structure described herein and changes in the interrelationships of the novel combinations of elements above described will suggest themselves to those skilled in the art. The embodiment described herein has been selected to illustrate a preferred implementation of the invention and is to be understood as not limiting the present invention as defined by the appended claims.

What is claimed is:

1. An expanding stabilizing fin cup for aerodynamically stabilizing a missile after launch, said missile having a tail portion including a propulsion means for generating a high pressure motive fluid disposed rearwardly thereof and attached thereto, said fin cup comprising:

a cylindrical cup attachable to said tail portion forwardly of said propulsion means; and means for spin stabilizing said missile said means comprising a plurality of flexible fins, expandable in one direction only each fin having a root integral with the wall of said cup;

whereby upon missile launch the high pressure motive fluid causes each of said plurality of fins to expand and unfold, in the same direction, outwardly from said wall of said cap by rotation about its root to spin stabilize said missile.

2. The fin cup of claim 1 wherein said cup is constructed out of the group consisting of hydroformed, spun, and drawn aluminum.

3. The fin cup of claim 1 wherein said cup is slotted in order to form said fins.

4. The fin cup of claim 3 wherein said cup further comprises:

an open end and a closed end, said closed end having a central orifice for the insertion of said propulsion means, and means for the attachment of said cup to said tail portion of said missile, said means being spaced radially outward of, and circumferentially about, said orifice.

5. The fin cup of claim 4 wherein said open end is provided with a reinforcing ring in order to reduce mishandling damage to said cup and to increase repeatability of performance of said cup.

6. An improved fin system for spin stabilizing a tube-launched projectile, said projectile having propulsion means affixed to its aft portion, said propulsion means providing a high pressure motive fluid, wherein the improvement comprises:

a cylindrical body attached to the aft portion of said projectile forwardly of said propulsion means, said body having a cavity in fluid communication with said propulsion means; means for spin stabilizing said missile said means comprising a plurality of flexible fins formed in the wall of said body, each fin being formed by a set of slots, each set comprising a first slot lying in a first plane transverse to the longitudinal axis of said body, a second set lying in a second plane transverse to said longitudinal axis, and a third slot, interconnecting an end of said first and second slots, which lies along a plane which is parallel to said longitudinal axis;

whereby upon launch of said projectile said pressure in said cavity causes all of said fins to expand out from said wall of said body in the same rotational direction into a position to spin stabilize the projectile as the projectile leaves the tube launcher.

7. The fin system of claim 6 wherein the fins expand out about a fourth unslotted side of each fin into a position which causes said projectile to spin stabilize.

8. The fin system of claim 6 wherein each fin has a root which is integral with the wall of said body, each root being perforated by a plurality of holes to allow said fins to expand more readily, said body having an open end and a closed end, an orifice formed in said closed end, said propulsion means being inserted through said orifice and extending partially into said cavity, and a plurality of holes formed in said closed end for receipt of fastening means to interconnect said body to said projectile, said holes being spaced radially from said orifice, whereby upon launch of said projectile the high pressure motive fluid forces said fins to an expanded state such that when said projectile leaves the tube launcher it can be spin stabilized.

9. The fin system of claim 8 wherein said body is made from the group consisting of hydroformed, spun, and drawn aluminum.

10. The fin system of claim 8 further comprising a reinforcing ring attached proximate said open end for protecting said body during handling and transportation and ensuring that said plurality of fins consistently expands as desired.

11. The expanding stabilizing fin cup of claim 1 wherein each fin is defined by a plurality of slots, and includes a root integral with said wall, said root being perforated by a plurality of holes in order to allow each said fin to expand more readily.

* * * * *